US005523581A

United States Patent [19]

Cadwalader

[11] Patent Number: 5,523,581

[45] Date of Patent: Jun. 4, 1996

[54] SLIPCOVER FOR RADIATION SHIELDS

[75] Inventor: Catherine W. Cadwalader, Overland Park, Kans.

[73] Assignee: WIT, Inc., Overland Park, Kans.

[21] Appl. No.: 311,169

[22] Filed: Sep. 23, 1994

[51] Int. Cl.[6] ..... G21F 3/02

[52] U.S. Cl. ..... 250/519.1; 250/516.1; 128/849

[58] Field of Search ..... 250/519.1, 515.1, 250/516.1; 128/849, 850, 852, 854

[56] References Cited

U.S. PATENT DOCUMENTS

| | | | |
|---|---|---|---|
| 3,310,053 | 3/1967 | Greenwood | 250/516.1 |
| 3,622,432 | 11/1971 | McCluer et al. | 250/519.1 |
| 4,220,867 | 9/1980 | Bloch, Jr. | 250/516.1 |
| 4,604,998 | 8/1986 | Bellina | 250/516.1 |
| 4,924,103 | 5/1990 | Stein et al. | 250/516.1 |
| 4,938,233 | 7/1990 | Orrison, Jr. | 128/489 |
| 5,015,865 | 5/1991 | Sayers | 250/519.1 |
| 5,115,140 | 5/1992 | Rodriguez | 250/516.1 |
| 5,245,195 | 9/1993 | Shah et al. | 250/515.1 |
| 5,379,332 | 1/1995 | Jacobson | 250/519.1 |

*Primary Examiner*—Jack I. Berman
*Assistant Examiner*—Kiet T. Nguyen
*Attorney, Agent, or Firm*—Foley & Lardner

[57] ABSTRACT

A slipcover or covering for containing a flexible radiation shield allows the radiation shield to be reused without experiencing staining. The slipcover may be configured to cover the thyroid area, male gonadal areas, female gonadal areas, breast area, hands, and eyes. The radiation shield includes a radiation attenuating material and is inserted within a pocket or pouch in the slipcover. The slipcover includes a fastener for selectively opening and closing the pocket. The slipcover is preferably made of a surgical drape material such as a wood pulp or polyester material. The radiation shield may be coated in a fabric material to ease placement and removal of the radiation shield into and out of the pocket.

20 Claims, 7 Drawing Sheets

SLIPCOVER FOR RADIATION SHIELDS

FIELD OF THE INVENTION

The present invention relates to a cover for a radiation shield, and more particularly to a disposable slipcover having a pocket for holding a flexible radiation shield,

BACKGROUND OF THE INVENTION

In general, radiation shields which cover portions of the body such as the thyroid area, male gonadal area, female gonadal area, breast area, hands, and eyes are known in the art. Examples of such radiation shields are described in U.S. Pat. No. 4,938,233, filed by Orrison, Jr., issued Jul. 3, 1990, entitled "Radiation Shield." These radiation shields are generally comprised of a body of radiation attenuating material and an attachment member. The attachment member of the radiation shield is configured to be worn around an appendage such as the head, neck, or waist so that the radiation attenuating material protects a particular body portion.

Radiation shields are intended for use in non-sterile environments during radiological diagnostic procedures or oncological treatments. The shields are worn by patients, clinicians, and physicians to selectively isolate, shroud and protect particular regions of the anatomy. These radiation shields are reusable. The same radiation shield may be worn hundreds of times by different practitioners and patients.

Prior radiation shields have been permanently coated with vinyl so that the shields may be cleaned after each use. The vinyl coating of the radiation shield is uncomfortable to wear adjacent the skin. The smooth surface of the coating also allows the shield to be easily dislodged once it is placed on the body.

Despite cleaning, the radiation shields often become soiled with bodily fluids or otherwise unsightly discolorations. These stained radiation shields, which often contain environmentally unfriendly materials, must be thrown away for eventual accumulation in landfills. Further, if the radiation shield is not properly cleaned, the patient or practitioner unknowingly wears a soiled or otherwise unsanitary shield. This is a particular problem for radiation shields which cover areas of the anatomy such as the gonadal region.

There is a need for a method which allows radiation shields to be hygienically reused. There is also a need for a low cost reusable radiation shield for protecting particular areas of the body.

SUMMARY OF THE INVENTION

The present invention relates to a radiation shield system including a flexible pad and a disposable covering. The flexible pad is made of a radiation attenuating material, and the disposable covering completely covers the pad.

The invention also relates to a disposable covering for a radiation shield. The covering includes a pair of thin, flexible sheets secured to each other along their edges to form a pouch with an open end. The covering may also have flaps or tabs on which cooperable fasteners (ties, snaps, Velcro hook and loop elements and the like) may be mounted for securing the radiation shield on a wearer, and a closure device for removably securing the shield in the pouch. The closure device may be a fastener that releasably closes the open end of the pouch, or a flap that can be tucked into the pocket or otherwise secured over the open end of the pocket.

The present invention further relates to a method of wearing a flexible pad made of a radiation attenuating material. The method comprises the steps of opening the pocket, inserting the flexible pad into the pocket, closing the pocket, attaching the pocket to a person, exposing the wearer to radiation (as in a radio-diagnostic procedure or treatment), then opening the pocket, removing the flexible pad from the pocket, and discarding the covering.

The present invention advantageously allows a radiation shield to be reused without sacrificing hygiene. Only the slipcover contacts the wearer's skin when the shield is worn. The covering is constructed from a disposable fabric material which allows the radiation shield to be comfortably placed and worn over particular portions of the body.

BRIEF DESCRIPTION OF THE DRAWINGS

Preferred embodiments of the invention will hereinafter be described in conjunction with the appended drawings, wherein like numerals denote like elements, and.

DETAILED DESCRIPTION OF PREFERRED EXEMPLARY EMBODIMENTS

Figure 1A:
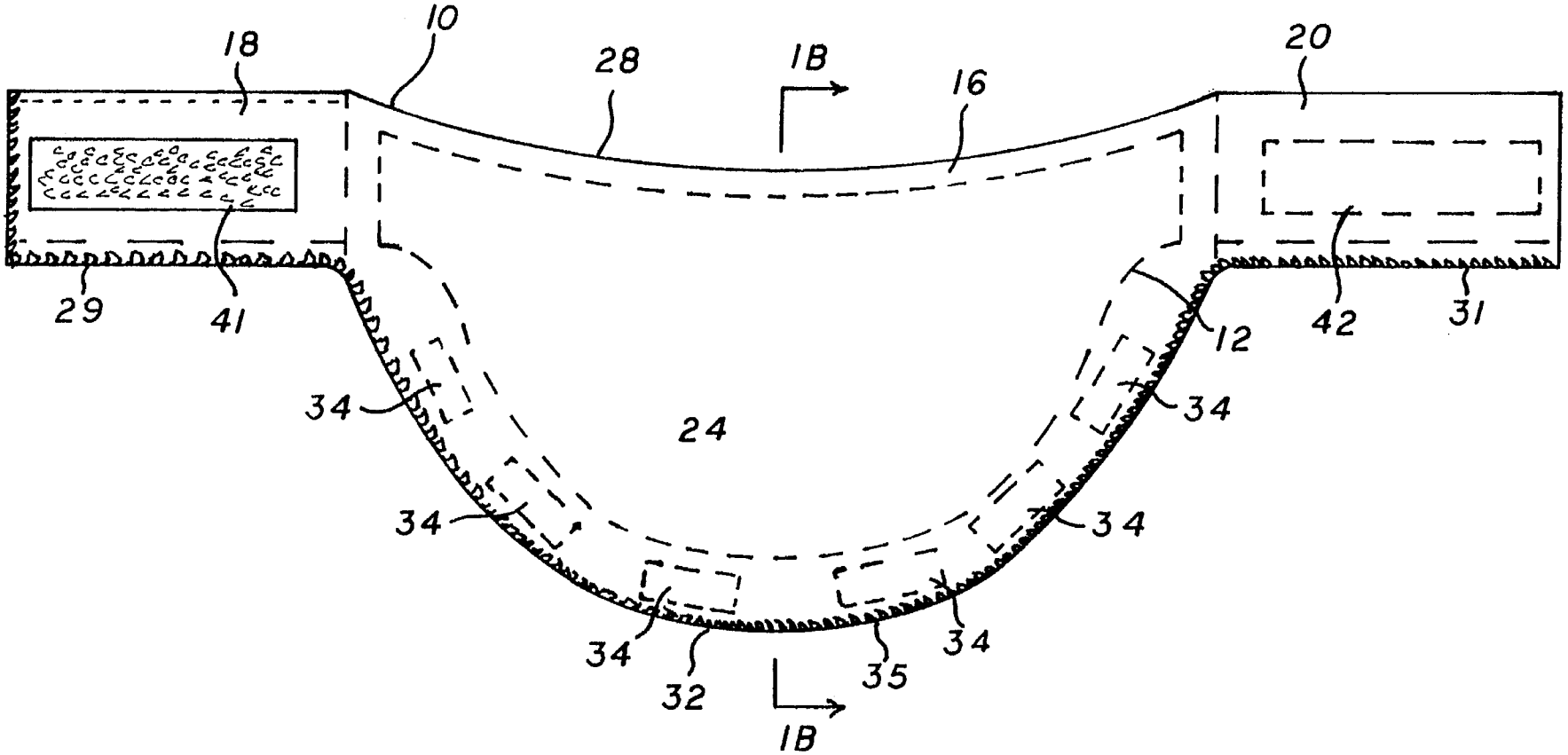
FIG. 1A is a top view of a radiation shield covering of the invention including a radiation shield according to a first embodiment of the present invention.

FIG. 1A shows a covering 10 containing a radiation shield 12 (shown in dashed lines) in accordance with the present invention. Radiation shield 12 includes a flexible radiation attenuating pad 13 (FIGS. 1B and 1C) made of a radiation attenuating material such as those pads described in U.S. Pat. No. 4,938,233, issued Jul. 3, 1990 to Orrison, Jr., the contents of which are incorporated by reference herein.

The radiation attenuating material is preferably comprised of a polymeric matrix uniformly charged with an attenuating filler. The filler is present in a ratio by weight of filler to polymeric matrix of 4:1 to 9:1 or even higher. The polymeric matrix is a viscoelastic material such as a viscoelastic vinyl polymer, vinyl-acetate copolymer, silicone, urethane, or a highly plasticized polyvinyl chloride. The polymeric matrix may include plasticizers such as dialkyl phthalate, diundecyl phthalate, dioctyl phthalate and diisononyl phthalate in a ratio of 5:1 to about 32:1 of plasticizer to resin. The attenuating filler may be a composition of barium, bismuth, iodine, uranium, or zirconium such as salts or oxides. Preferably, the filler is $BaSO_4$ having an average filler particulate size of 4 micrometers or less. Also, a viscosity modifying agent (surfactant) in a range of 0.1 to 5.0 by weight such as BYK1142, manufactured by BYK Chemie, Wallingford, Conn. can be present to increase the amount of loading of the filler in the matrix.

Although covering 10 is configured to hold a thyroid radiation such as shield 12, covering 10 is not confined to such use and can also be configured for use as a gonadal shield, eye shield, chest shield, breast shield or other flexible radiation shield. Covering 10 includes a pouch or central pocket 16, integral with a first attachment flap 18 and a second attachment flap 20 extending from opposite sides of pocket 16. Pocket 16 holds radiation shield 12.

Covering 10 is preferably made of a hypo-allergenic fabric material such as surgical drape material, but can also be made of a non-fabric material such as thin plastic sheets, non-woven paper products, or inexpensive covering materials. The surgical drape material is a polyester or wood pulp/polyester combination having a barrier finish or soft, absorbent finish such as those made by Precision Fabric Group, Inc., Greensboro, N.C. and suitable for disposal in refuse containers.

Figure 1B:
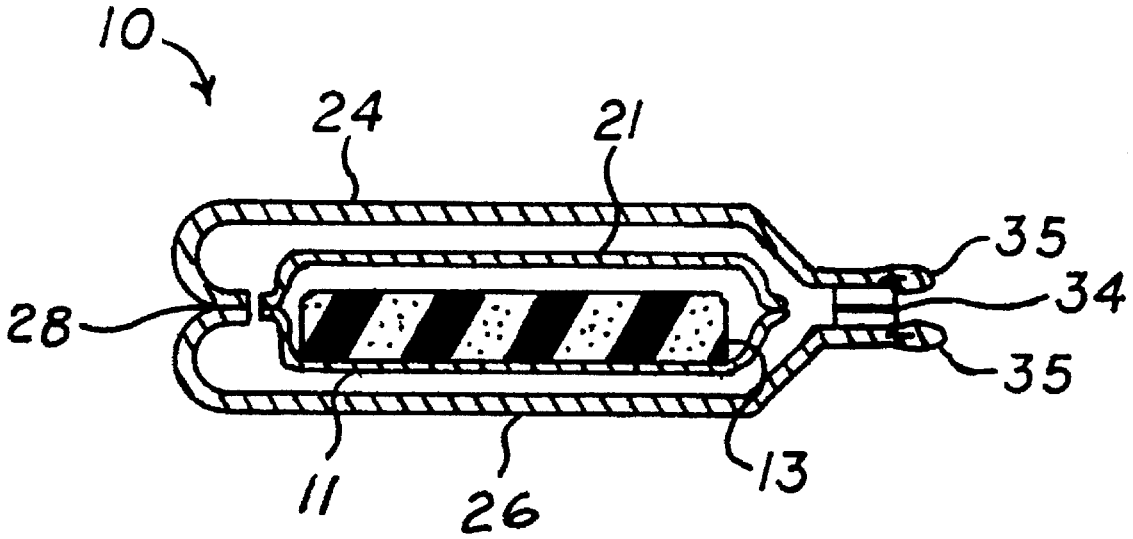
FIG. 1B is a cross sectional view along the line 1B—1B in FIG. 1A.

With reference to FIG. 1B, covering 10 is constructed from a front sheet 24 and a back sheet 26 which are sewn together along a finished edge 28, a raw edge 29 (FIG. 1A), and a raw edge 31 of FIG. 1A. Alternatively, covering 10 may be made from a single sheet creased or folded along edge 28. Front sheet 24 and back sheet 26 are releaseably secured to each other with hook and loop fastener strips 34 disposed in opposed positions on the inside of each of sheets 24 and 26 about the periphery of a wide, curved opening 32.

Hook and loop fastener strips 34 are strong enough to resist the weight of radiation shield 12 and ensure that pocket 25 does not accidentally open. Edges 35 of opening 32 are preferably raw edges stitched over folded ends of sheets 24 and 26 with a zigzag or surge stitch. Opening 32, which spans the width of pocket 16, is large enough to allow radiation shield 12 to be conveniently inserted into and removed from covering 10.

Attachment flaps 18 and 20 are configured to releasably surround an appendage of the body. For example, if shield 12 is a thyroid shield, attachment flaps 18 and 20 are configured to releasably surround the neck of the wearer and secure shield 12 proximate the thyroid region. Attachment flaps 18 and 20 may be tied around the appendage or utilize a releasable fastener. Attachment flaps 18 and 20 may include a releasable fastener such as a loop element 41 and a hook element 42 of a hook and loop fastener, i.e., a VELCRO® fastener. Elements 41 and 42 are sewn on opposite sides of flaps 18 and 20, respectively. Tie-strings may be substituted for flaps 18 and 20.

Figure 1C:
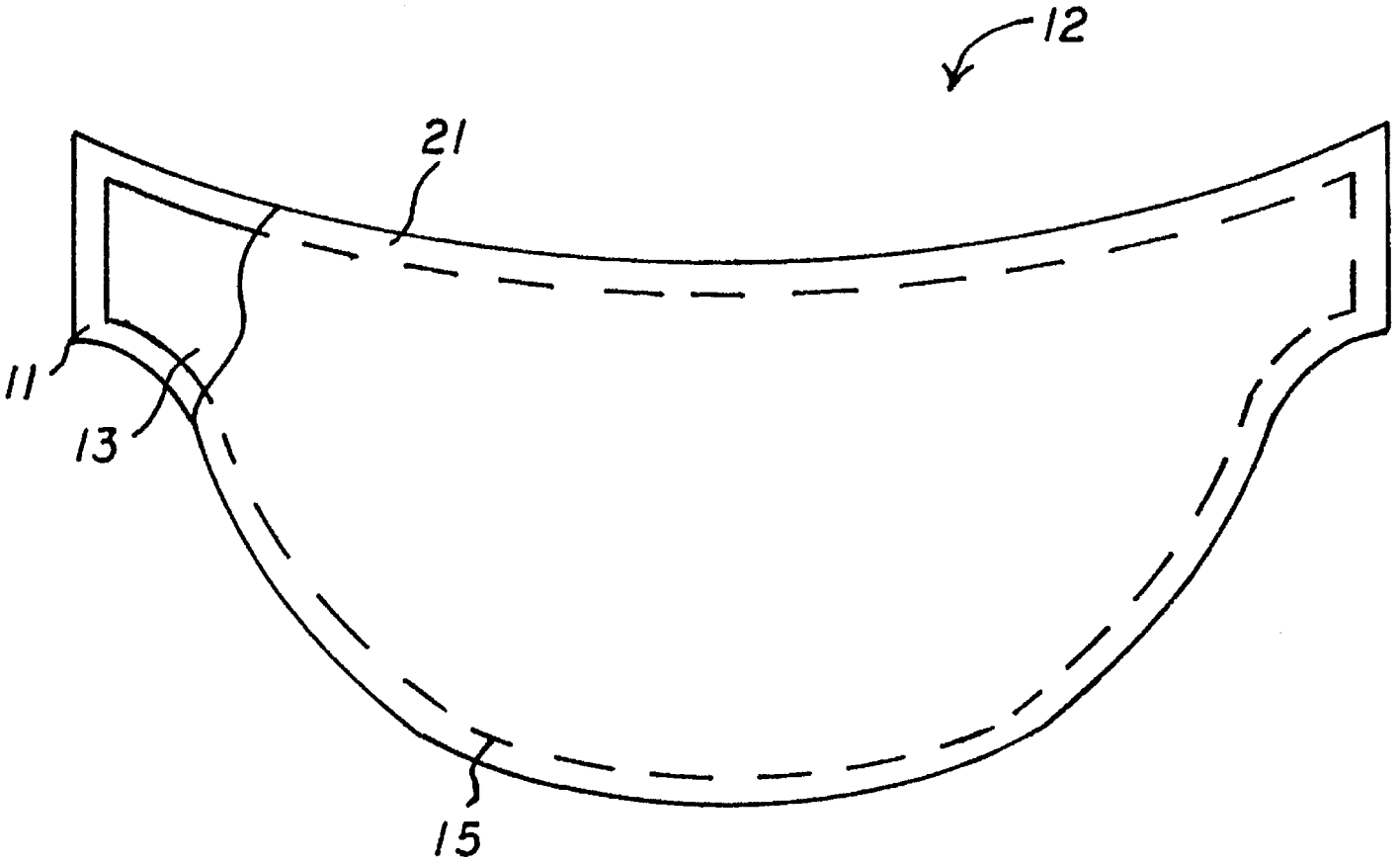
FIG. 1C is a top view of the radiation shield which is disposed in the pocket of the covering illustrated in FIG. 1A.

With reference to FIGS. 1B and 1C, flexible shield 12 includes a bottom sheet 11 and top sheet 21 of fabric material such as surgical drape enclosing a thin, flexible pad 13 of radiation attenuating material (shown in sectional view). Pad 13, which may be tacky, is advantageously covered by sheets 11 and 21 to ease placement and removal of shield 12 into and out of covering 10. Shield 12 is shown in FIG. 1C with a portion of top sheet 21 removed to expose radiation attenuating pad 13. Sheets 11 and 21 are sewn together along a stitch 15 about the periphery of pad 13. Preferably, the radiation attenuating pad 13 of shield 12 is adhesively secured or integrated on top of at least one of sheets 11 or 21 to prevent sagging of pad 13 within sheets 11 and 21. Pad 13 may be coated in a 0.003 inch thick plastic cover such as polyethylene or polyurethane.

Figure 2:
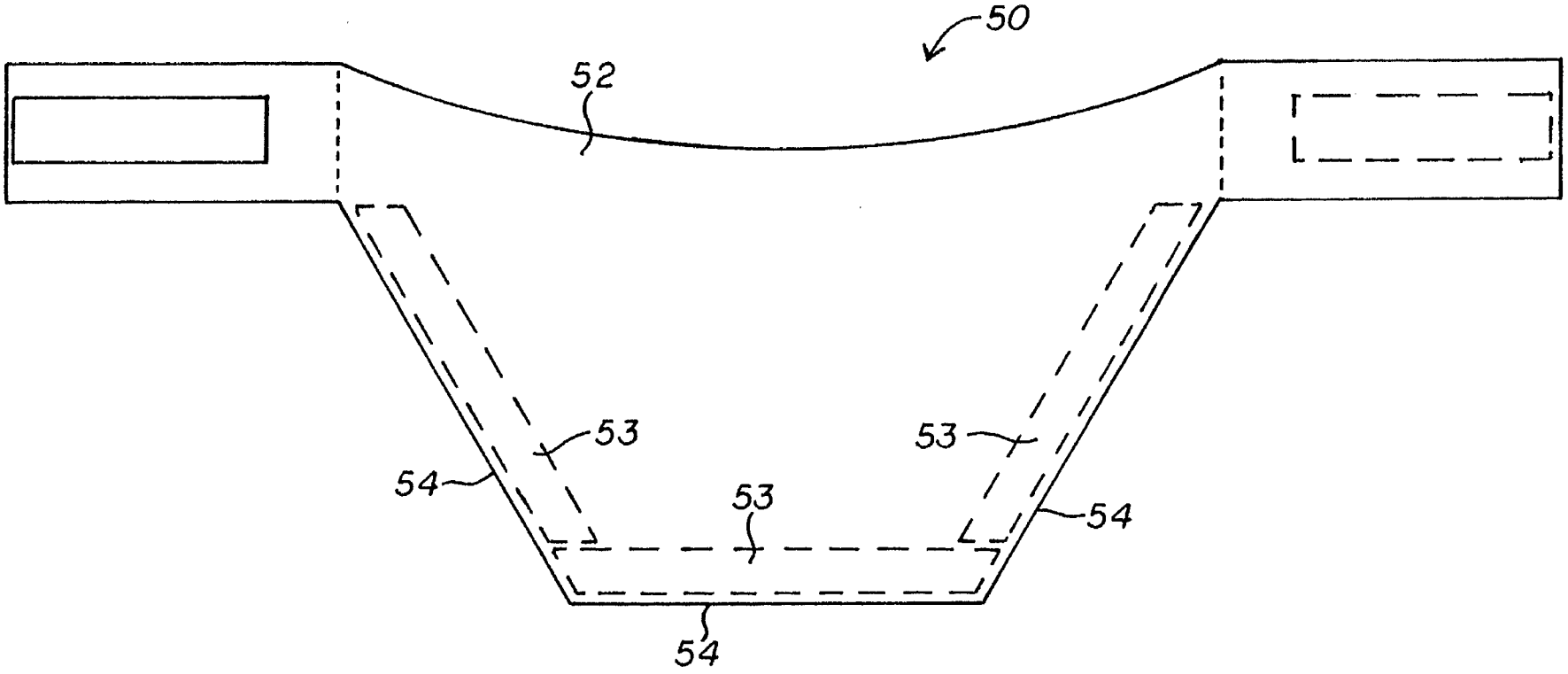
FIG. 2 is top view of a radiation shield covering in accordance with a second embodiment of the present invention.

FIG. 2 illustrates another embodiment of a slipcover or covering 50 substantially similar to covering 10 illustrated in FIG. 1A wherein covering 50 has a pouch or pocket 52 which is defined by substantially straight edges 54. Substantially straight edges 54 allow easy manufacture of covering 50 and easy placement of fasteners 53. Fasteners 53 are preferably strips of two sided tape disposed on the inside of pocket 52 along edges 54.

Figure 3A:
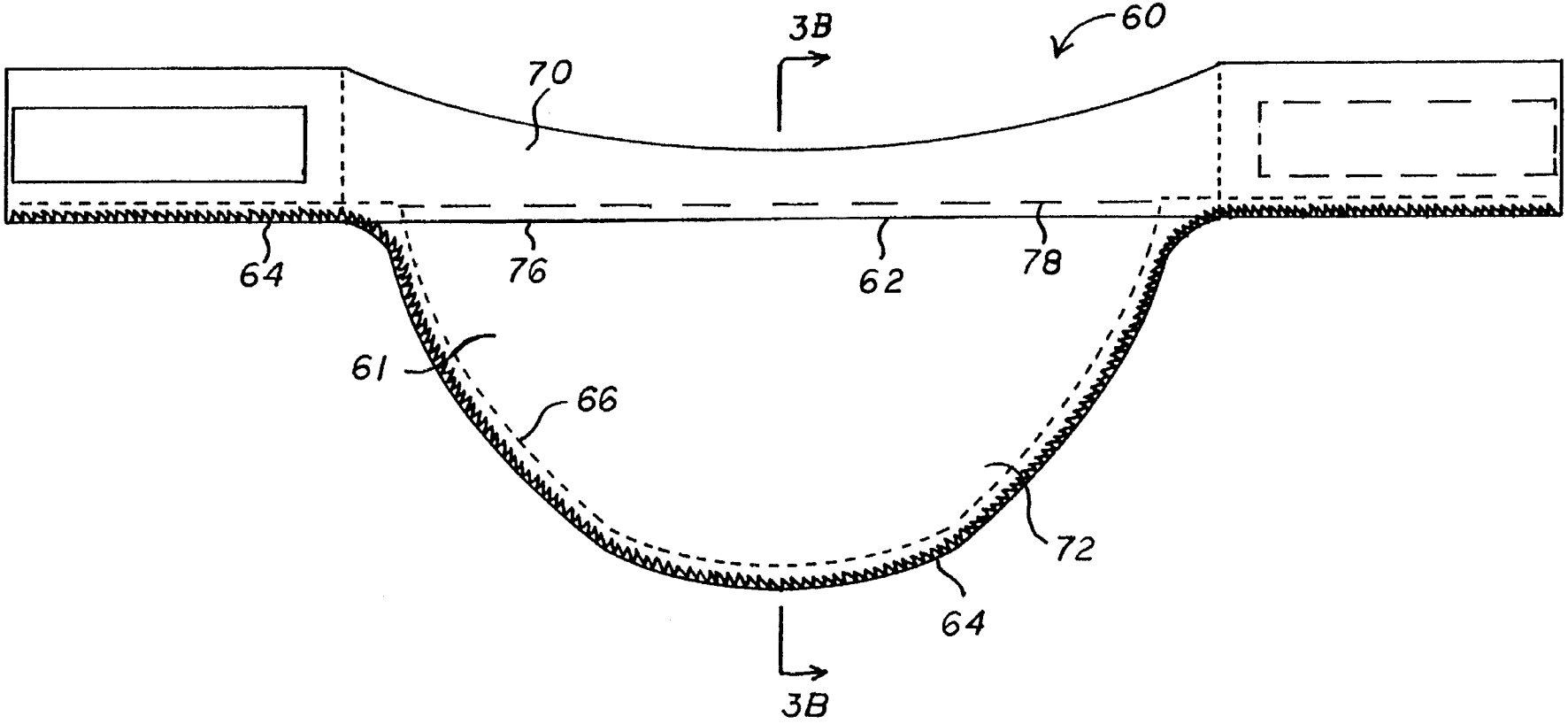
FIG. 3A is a top view of a radiation shield covering in accordance with a third embodiment of the present invention.
Figure 3B:
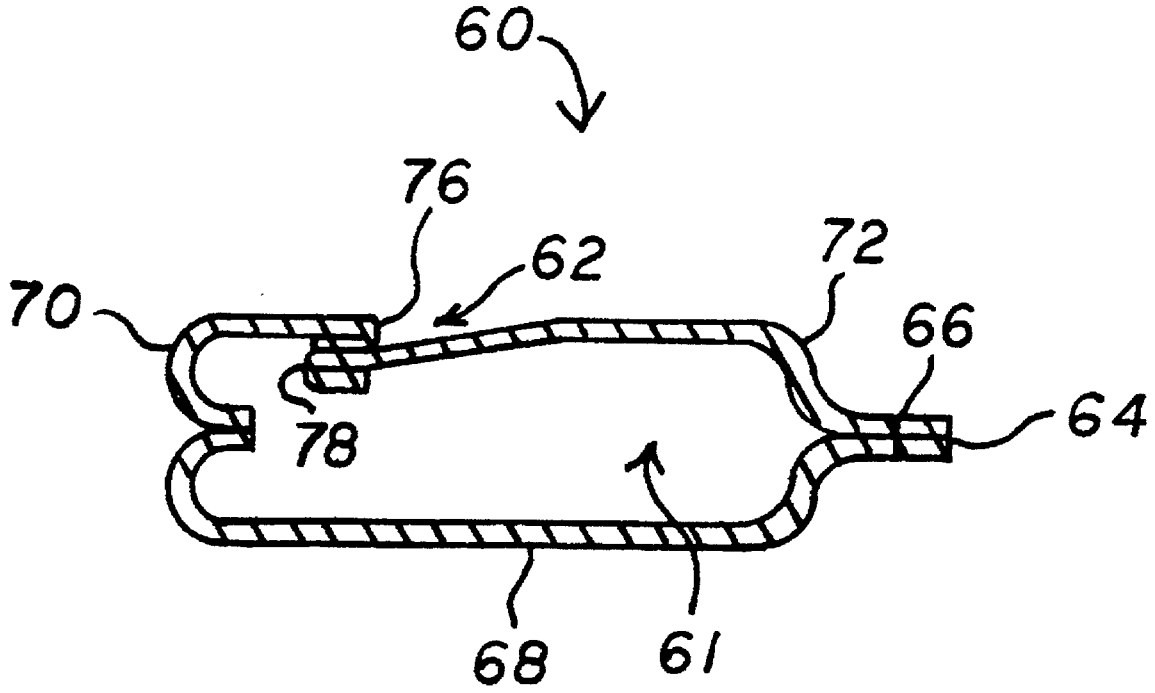
FIG. 3B is a cross section along the line 3B— 3B in FIG. 3A.

FIGS. 3A and 3B show a further alternative embodiment of a covering 60 having a horizontal overlapping slit or opening 62. Covering 60 is constructed of a back sheet 68 having the same peripheral shape as covering 60, a top front sheet 70, and a bottom front sheet 72. Back sheet 68 is zigzag or surge stitched to bottom front sheet 72 along a bottom outside edge 64. An interior straight stitch 66 is provided around the curved periphery of a pocket 61 along edge 64 and enables covering 60 to more securely hold radiation shield 12 in pocket 61.

Pocket 61 is located between bottom front sheet 72 and back sheet 68. A bottom edge 76 of top front sheet 70 overlaps a top edge 78 of bottom front sheet 72 along opening 62, thereby securing shield 12 in pocket 61. Opening 62 may also include fasteners for more securely closing pocket 61. Preferably, edges 76 and 78 are finished edges so that opening 62 can be taped shut after shield 12 is inserted. If the overlap is sufficient, however, no fastening device is needed. Alternatively, covering 60 may be configured to have a vertical opening with overlapping left and right sheets.

Figure 4:
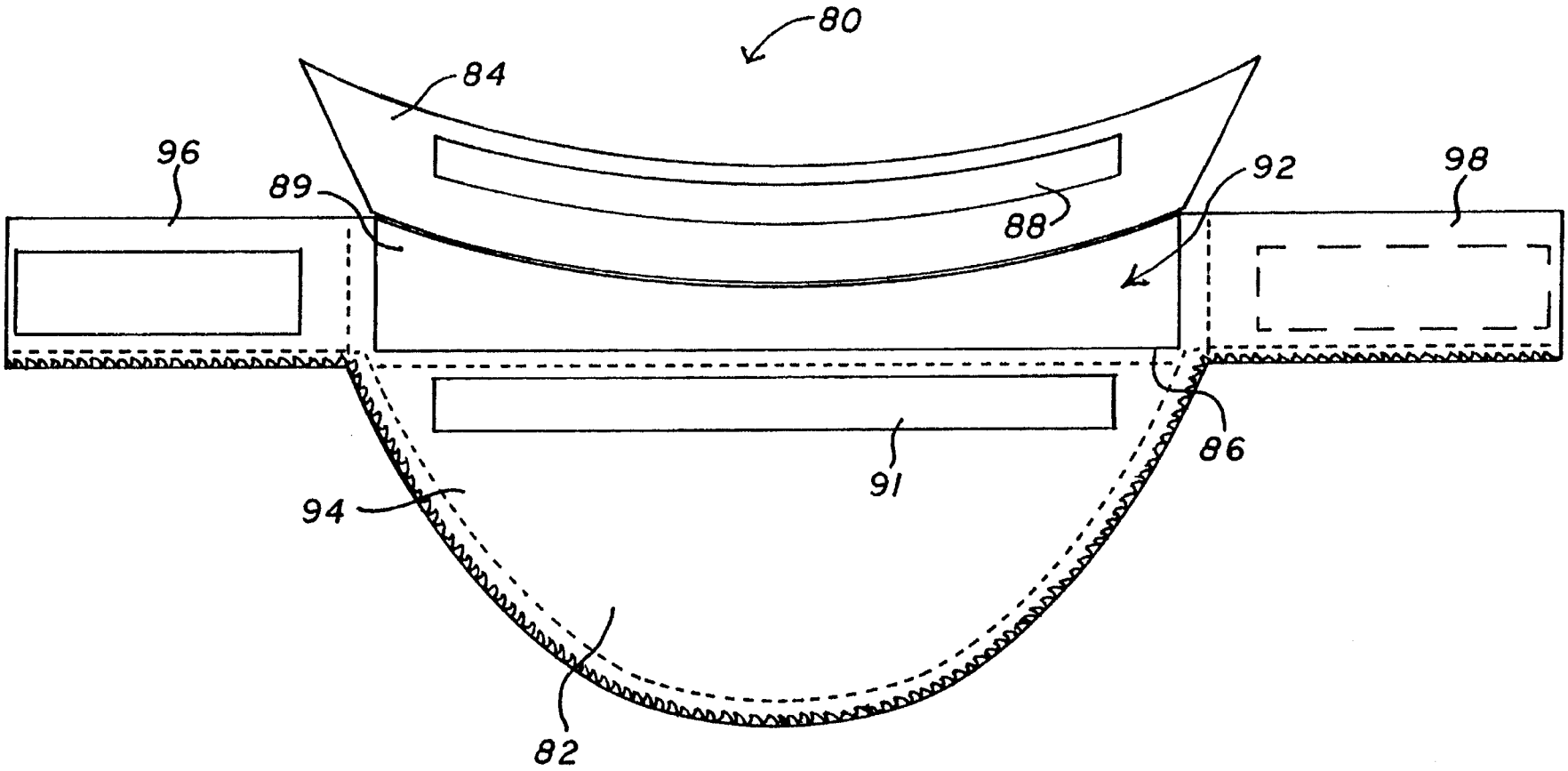
FIG. 4 is a top view of a radiation shield covering in accordance with a fourth preferred exemplary embodiment of the present invention.

FIG. 4 shows a further alternative embodiment of a covering 80, similar to covering 60 illustrated in FIG. 3A, wherein covering 80 includes an envelope flap 84. Covering 80 is constructed from a back sheet 89 to which flap 84, a front sheet 94, a first side flap sheet 96 and a second side flap sheet 98 are sewn. Pouch or pocket 82 is defined between front sheet 94 and back sheet 89. Envelope flap 84 may simply be folded underneath a bottom edge 86 to secure shield 12 in a pocket 82. Alternatively, envelope flap 84 can include a hook element 88, and front sheet 94 can include a loop element 91. Preferably, flap 84 is approximately an inch wide so that shield 12 is secured in pocket 82 by flap 84, and yet flap 84 does not bulk up within covering 80 making covering 80 uncomfortable to wear. Opening 92, as defined by flap 84, is preferably large enough to allow shield 12 for convenient insertion and removal of pocket 82.

It is to be understood that, while the detailed description and drawings show specific examples of the present invention, they are for the purposes of illustration only. The present invention is not limited to the precise details and conditions disclosed. For example, although covers are shown for thyroid shields, the covers may be configured for other uses such gonadal shields, eye shields, thoracic shields, or other radiation shields. Further, although a paper-based fabric is utilized, other materials may be suitable for use as slipcovers for radiation shields.

What is claimed is:

1. A radiation shield system for medical procedures, comprising:

a flexible pad made of a radiation attenuating material comprised of a viscoelastic material charged with a radiation attenuating filler, the flexible pad being permanently secured in a casing to ease placement and removal of the flexible pad; and a paper-based fabric disposable covering for the pad which completely covers the pad.

2. The shield system of claim 1, further comprising means for attaching the disposable covering to a wearer.

3. The shield system of claim 1 wherein the disposable covering is made of a surgical drape fabric.

4. The shield system of claim 1 wherein the casing is comprised of a plurality of fabric sheets to ease placement and removal of the flexible pad into and out of the disposable covering.

5. The shield system of claim 1 wherein the covering has a pocket for holding the pad.

6. The shield system of claim 5 wherein the pocket has a closure device.

7. A method of wearing a flexible pad made of a radiation attenuating material for a medical procedure, comprising the steps of:

inserting the flexible pad into a pocket of a paper-based disposable fabric cover;

closing the pocket;

attaching the paper-based fabric disposable cover to a person;

exposing the person to radiation;

opening the pocket;

removing the flexible pad from the pocket of the paper-based fabric disposable cover; and discarding the paper-based fabric disposable cover.

8. A disposable covering for a radiation shield worn proximate an appendage of a person for a medical procedure, the disposable covering comprising:

first and second thin, flexible sheets of paper-based fabric secured to each other to define a pouch for securing the radiation shield, the first and second sheets being joined to form a finished edge, the pouch having an open end for insertion and removal of the radiation shield, the open end being defined by a plurality of raw edges on the first thin, flexible sheet and the second thin, flexible sheet, the raw edges including a zig-zag stitches;

means for selectively closing and opening the pouch; and an attachment device configured to releasably secure the covering to the person.

9. The covering of claim 8 wherein the means for selectively closing and opening is comprised of hook and loop strips.

10. The covering of claim 8 wherein the means for selectively closing and opening is a two-sided tape strip.

11. The covering of claim 8 wherein the means for selectively closing and opening is a closure flap disposed proximate the open end that overlaps the open end.

12. The covering of claim 11 wherein the closure flap further includes at least one of two-sided tape, VELCRO®, or snap fasteners.

13. The covering of claim 8 wherein the first and second sheets are formed as a single creased sheet.

14. The covering of claim 8 wherein the open end is defined by a slit in the pouch substantially parallel to a top edge of the pouch.

15. The covering of claim 8 wherein the open end is defined by a slit in the pouch substantially parallel to a top edge of the pouch, and the means for selectively closing and opening is a flap.

16. The covering of claim 8 wherein the pouch is made from surgical drape material.

17. The covering of claim 16 wherein the attachment device includes VELCRO® strip fasteners.

18. The covering of claim 16 wherein the attachment device is configured for attaching to a neck of the person.

19. The covering of claim 8 wherein the attachment device is mounted on a pair of fastening flaps integral the pouch body, the fastening flaps being configured to surround the appendage.

20. The covering of claim 8 further including an overlapping slit in the pouch proximate the open end.

* * * * *